US009091971B2

(12) United States Patent
Takahashi et al.

(10) Patent No.: US 9,091,971 B2
(45) Date of Patent: Jul. 28, 2015

(54) IMAGE-FORMING APPARATUS

(71) Applicant: Fuji Xerox Co., Ltd., Minato-ku, Tokyo (JP)

(72) Inventors: Sakon Takahashi, Kanagawa (JP); Yutaka Kiuchi, Kanagawa (JP); Masayo Higashimura, Kanagawa (JP); Atsumi Kurita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/079,796

(22) Filed: Nov. 14, 2013

(65) Prior Publication Data

US 2014/0369723 A1 Dec. 18, 2014

(30) Foreign Application Priority Data

Jun. 14, 2013 (JP) ..... 2013-126099

(51) Int. Cl.
*G03G 15/20* (2006.01)

(52) U.S. Cl.
CPC ..... *G03G 15/2014* (2013.01)

(58) Field of Classification Search
CPC ..... G03G 15/0105; G03G 15/2075; G03G 15/6588; G03G 15/6591; G03G 15/6594; G03G 2215/2074; G03G 2215/209; G03G 2215/2083
See application file for complete search history.

(56) References Cited

U.S. PATENT DOCUMENTS

| | | | | |
|---|---|---|---|---|
| 5,555,074 | A * | 9/1996 | Haragakiuchi et al. | 399/69 |
| 2006/0140677 | A1* | 6/2006 | Fukatsu et al. | 399/223 |
| 2012/0251168 | A1* | 10/2012 | Nagayama et al. | 399/111 |
| 2013/0004742 | A1* | 1/2013 | La Costa | 428/195.1 |

FOREIGN PATENT DOCUMENTS

| | | | |
|---|---|---|---|
| JP | 2006-209090 | A | 8/2006 |
| JP | 2012-032564 | A | 2/2012 |
| JP | 2012-098655 | A | 5/2012 |

* cited by examiner

*Primary Examiner* — Claytohn E Laballe
*Assistant Examiner* — Victor Verbitsky
(74) *Attorney, Agent, or Firm* — Sughrue Mion, PLLC

(57) ABSTRACT

An image-forming apparatus includes an image unit that forms an image using at least one of a white toner and a color toner having a lower storage modulus than the white toner and a fixing unit that fixes the image to a medium with heat. A time P calculated by subtracting a fixing time for which an image of the color toner alone is fixed to normal paper used as the medium from a fixing time for which an overlaid image of the white toner and the color toner is fixed to color paper used as the medium is more than 0 ms and less than 30 ms.

13 Claims, 8 Drawing Sheets

FIG. 10

| | G' OF WHITE TONER (Pa) | G' OF COLOR TONER (Pa) | P1 | P2 | F1 | F2 | P1−P2 | F1−P2 |
|---|---|---|---|---|---|---|---|---|
| EXAMPLE 1 | 1.0×10E3 | 1.0×10E2 | 37 | 30 | 60 | 37 | 7 | 23 |
| EXAMPLE 2 | 1.0×10E3 | 1.0×10E2 | 65 | 56 | 94 | 65 | 9 | 29 |
| EXAMPLE 3 | 1.0×10E3 | 1.0×10E2 | 31 | 30 | 60 | 37 | 1 | 29 |
| EXAMPLE 4 | 1.0×10E3 | 1.0×10E2 | 37 | 30 | 48 | 37 | 7 | 11 |
| EXAMPLE 5 | 1.0×10E3 | 1.0×10E2 | 65 | 56 | 144 | 65 | 9 | 79 |
| COMPARATIVE EXAMPLE 1 | 1.0×10E3 | 1.0×10E2 | 30 | 30 | 60 | 37 | 0 | 30 |
| COMPARATIVE EXAMPLE 2 | 1.0×10E3 | 1.0×10E2 | 87 | 56 | 94 | 65 | 31 | 7 |
| COMPARATIVE EXAMPLE 3 | 1.0×10E3 | 1.0×10E2 | 65 | 56 | 74 | 65 | 9 | 9 |
| COMPARATIVE EXAMPLE 4 | 1.0×10E3 | 1.0×10E2 | 65 | 56 | 146 | 65 | 9 | 81 |
| COMPARATIVE EXAMPLE 5 | 1.0×10E4.2 | 1.0×10E2 | 37 | 30 | 60 | 37 | 7 | 23 |

FIG. 11

| | PAPER | | | | FILM | | | |
|---|---|---|---|---|---|---|---|---|
| | CREASE WIDTH (TARGET: ≤0.5 mm) | | | | PENCIL HARDNESS (TARGET: ≥H) | | | |
| | WHITE AND COLOR TONERS (BLACK PAPER) | | COLOR TONERS (WHITE PAPER) | | WHITE AND COLOR TONERS | | COLOR TONERS | |
| | CREASE WIDTH (mm) | EVALUATION | CREASE WIDTH (mm) | EVALUATION | PENCIL HARDNESS | EVALUATION | PENCIL HARDNESS | EVALUATION |
| EXAMPLE 1 | 0.2 | GOOD | 0.2 | GOOD | 2H | GOOD | 2H | GOOD |
| EXAMPLE 2 | 0.2 | GOOD | 0.2 | GOOD | 2H | GOOD | 2H | GOOD |
| EXAMPLE 3 | 0.5 | GOOD | 0.2 | GOOD | 2H | GOOD | 2H | GOOD |
| EXAMPLE 4 | 0.2 | GOOD | 0.2 | GOOD | H | GOOD | 2H | GOOD |
| EXAMPLE 5 | 0.3 | GOOD | 0.2 | GOOD | 4H | GOOD | 2H | GOOD |
| COMPARATIVE EXAMPLE 1 | 0.6 | POOR | 0.2 | GOOD | 2H | GOOD | 2H | GOOD |
| COMPARATIVE EXAMPLE 2 | 0 | GOOD | 0.2 | GOOD | 2H | GOOD | 2H | GOOD |
| COMPARATIVE EXAMPLE 3 | 0.2 | GOOD | 0.2 | GOOD | 2B | POOR | 2H | GOOD |
| COMPARATIVE EXAMPLE 4 | 0.2 | GOOD | 0.2 | GOOD | 4H | GOOD | 2H | GOOD |
| COMPARATIVE EXAMPLE 5 | 0.5 | POOR | 0.2 | GOOD | B | POOR | 2H | GOOD |

FIG. 12

| | PAPER (BLACK PAPER) | | | FILM (ON BLACK PAPER) | | |
|---|---|---|---|---|---|---|
| | TARGET: a* > 48 | | | TARGET: c* > 60 | | |
| | a* | EVALUATION | REMARKS | c* | EVALUATION | REMARKS |
| EXAMPLE 1 | 50 | GOOD | | 65 | GOOD | |
| EXAMPLE 2 | 51 | GOOD | | 64 | GOOD | |
| EXAMPLE 3 | 49 | GOOD | SAMPLE IS SLIGHTLY WHITISH AND EXHIBITS DECREASE IN COLOR REPRODUCIBILITY. | 65 | GOOD | |
| EXAMPLE 4 | 50 | GOOD | | 61 | GOOD | SAMPLE EXHIBITS SLIGHT DECREASE IN SATURATION DUE TO INSUFFICIENTLY MELTED UNDERLAYER OF WHITE TONER. |
| EXAMPLE 5 | 51 | GOOD | | 67 | GOOD | SAMPLE EXHIBITS HIGH GLOSS IN SURFACE AND SLIGHTLY UNEVEN MELTING AT EDGES. |
| COMPARATIVE EXAMPLE 1 | 47 | POOR | SAMPLE EXHIBITS DECREASE IN COLOR REPRODUCIBILITY DUE TO POOR FIXING OF WHITE TONER AND DECREASED HIDING POWER. | 65 | GOOD | |
| COMPARATIVE EXAMPLE 2 | 46 | POOR | SAMPLE EXHIBITS DECREASE IN COLOR REPRODUCIBILITY DUE TO ABSORPTION OF TONER. WHITE TONER IS EXPOSED AT PROTRUSIONS BECAUSE OF ABSORPTION OF COLOR TONER FROM PROTRUSIONS INTO RECESSES. | 64 | GOOD | |
| COMPARATIVE EXAMPLE 3 | 51 | GOOD | | 57 | POOR | SAMPLE EXHIBITS DECREASE IN COLOR REPRODUCIBILITY DUE TO POOR FIXING AND DECREASED HIDING POWER BECAUSE OF UNMELTED UNDERLAYER OF WHITE TONER. |
| COMPARATIVE EXAMPLE 4 | 51 | GOOD | | – | POOR | IMAGE QUALITY TEST CANNOT BE PERFORMED BECAUSE OF OFFSET. |
| COMPARATIVE EXAMPLE 5 | 47 | POOR | SAMPLE IS WHITISH DUE TO POOR FIXING OF WHITE TONER. | 67 | GOOD | |

IMAGE-FORMING APPARATUS

CROSS-REFERENCE TO RELATED APPLICATIONS

This application is based on and claims priority under 35 USC 119 from Japanese Patent Application No. 2013-126099 filed Jun. 14, 2013.

BACKGROUND

Technical Field

The present invention relates to image-forming apparatuses.

SUMMARY

According to an aspect of the invention, there is provided an image-forming apparatus including an image unit that forms an image using at least one of a white toner and a color toner having a lower storage modulus than the white toner and a fixing unit that fixes the image to a medium with heat. A time P calculated by subtracting a fixing time for which an image of the color toner alone is fixed to normal paper used as the medium from a fixing time for which an overlaid image of the white toner and the color toner is fixed to color paper used as the medium is more than 0 ms and less than 30 ms.

BRIEF DESCRIPTION OF THE DRAWINGS

Exemplary embodiments of the present invention will be described in detail based on the following figures, wherein:

FIG. 10 is a table showing the fixing conditions for the Examples and the Comparative Examples;

FIG. 11 is a table showing the results of a fixing test for the Examples and the Comparative Examples; and FIG. 12 is a table showing the results of an image quality test for the Examples and the Comparative Examples.

DETAILED DESCRIPTION

Figure 1:
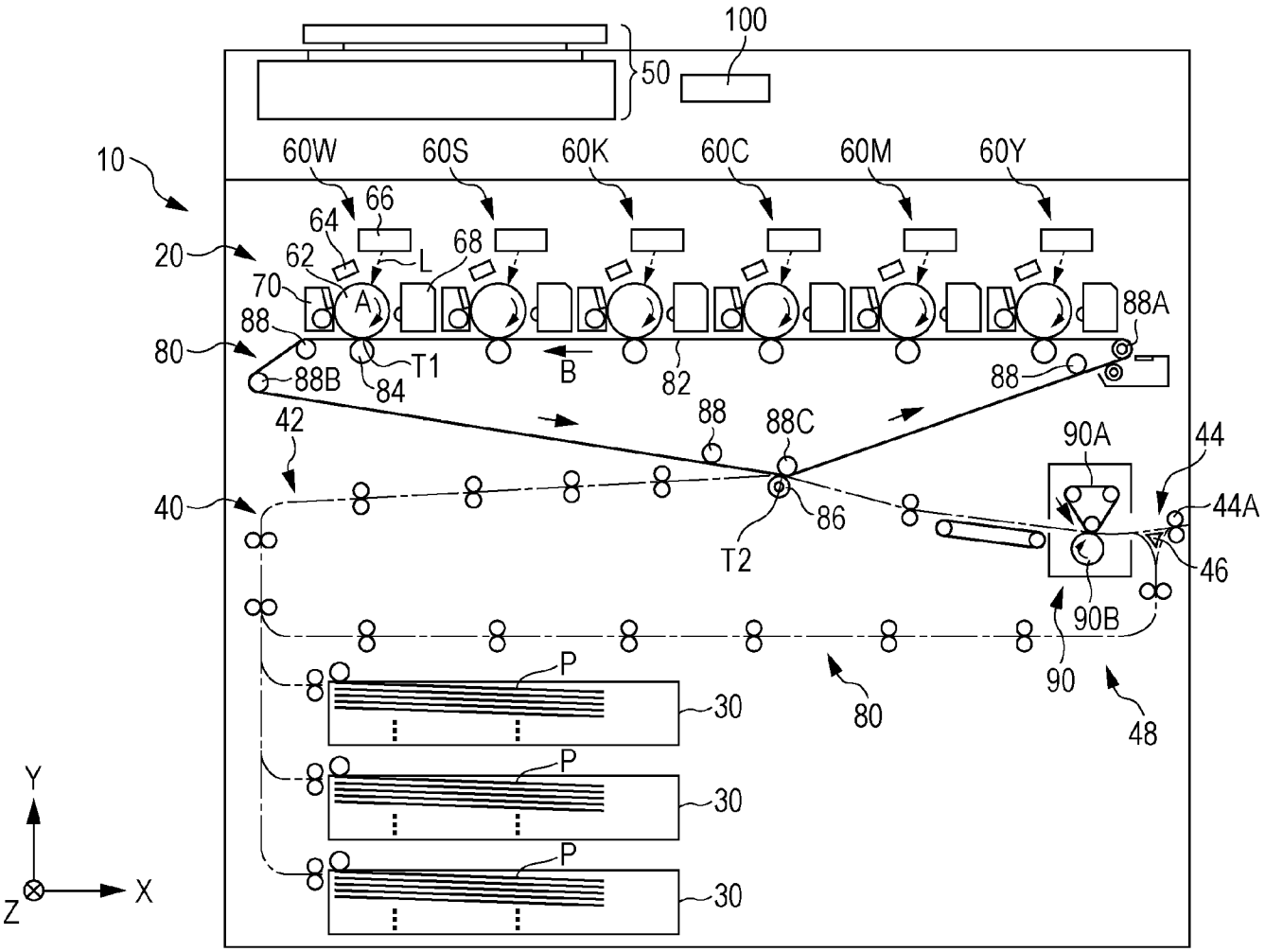
FIG. 1 is a schematic view illustrating the overall structure of an image-forming apparatus according to a first exemplary embodiment.

Exemplary embodiments of the present invention will now be described with reference to the drawings. The structure of an image-forming apparatus will be described first, and then the normal and special operations of the image-forming apparatus will be described. In the following description, the direction indicated by arrow Y in FIG. 1 is referred to as "apparatus height direction", and the direction indicated by arrow X in FIG. 1 is referred to as "apparatus width direction". The direction perpendicular to the apparatus height direction and the apparatus width direction is referred to as "apparatus depth direction" (indicated by arrow Z).

First Exemplary Embodiment

Structure of Image-Forming Apparatus

FIG. 1 is a schematic front view illustrating the overall structure of an image-forming apparatus 10 according to a first exemplary embodiment. As shown in FIG. 1, the image-forming apparatus 10 includes an electrophotographic image-forming section 20 that forms an image on a medium P, a medium transport section 40 that transports the medium P, and a document reader 50 that reads a document to be read (not shown). The image-forming apparatus 10 also includes medium containers 30 each containing a stack of media P and a controller 100 that controls the various sections.

Image-Forming Section

As shown in FIG. 1, the image-forming section 20 includes toner-image forming units 60Y, 60M, 60C, 60K, 60S, and 60W provided for yellow (Y), magenta (M), cyan (C), black (K), special color (S), and white (W) toners, respectively, an intermediate transfer device 80, and a fixing device 90.

The toner-image forming units 60Y, 60M, 60C, 60K, 60S, and 60W are examples of image units. The intermediate transfer device 80 is an example of a transfer unit. The fixing device 90 is an example of a fixing unit.

Yellow (Y), magenta (M), cyan (C), black (K), special color (S), and white (W) are examples of toner colors. The white (W) toner is an example of a white toner. The yellow (Y), magenta (M), cyan (C), and black (K) toners are examples of color toners.

The special color (S) is a color other than yellow (Y), magenta (M), cyan (C), black (K), and white (W). Examples of special colors (S) include gold (G), silver (S), transparent color (CL), and corporate colors (C/C). Corporate colors (C/C) are colors that are unique to individual users and are more frequently used than other colors.

Toner-Image Forming Unit

The toner-image forming units 60Y, 60M, 60C, 60K, 60S, and 60W have substantially the same structure except for the toner used. Therefore, in FIG. 1, reference numerals are provided for the components of the toner-image forming unit 60W and not for the components of the toner-image forming units 60Y, 60M, 60C, 60K, and 60S. The toner-image forming units 60Y, 60M, 60C, 60K, 60S, and 60W and the components thereof will now be described, where the suffixes Y, M, C, K, S, and W are omitted unless necessary.

Figure 2:
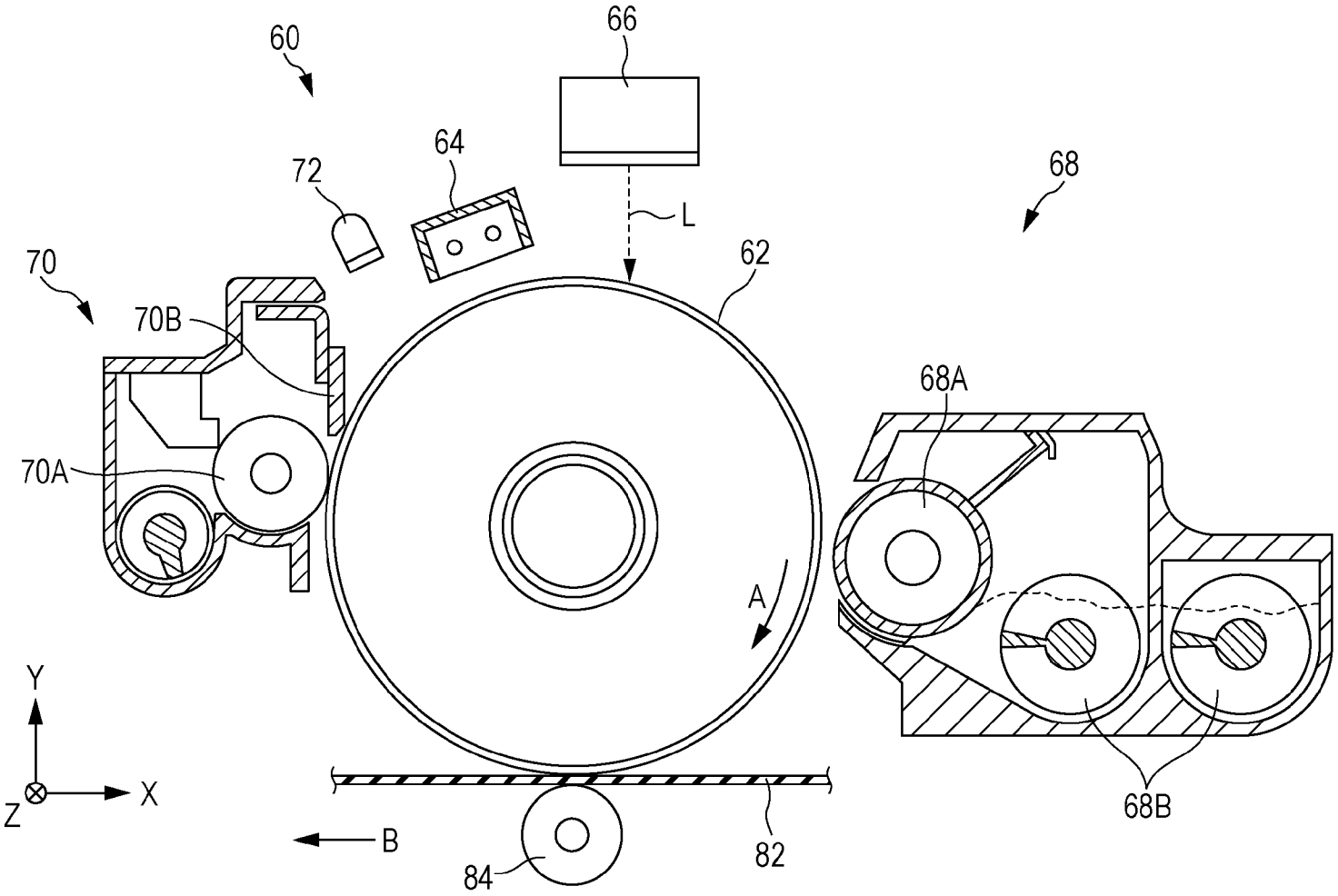
FIG. 2 is a schematic view illustrating the structure of each toner-image forming unit and the surrounding units according to the first exemplary embodiment.

FIG. 2 is a schematic front view illustrating the structure of each toner-image forming unit 60 and the surrounding units. As shown in FIG. 2, the toner-image forming unit 60 includes a photoreceptor drum 62, a charging device 64, an exposure device 66, a developing device 68, a removing device 70, and an erasing device 72.

The photoreceptor drum 62 is an example of an image carrier. The charging device 64 is an example of a charging unit. The exposure device 66 is an example of a latent-image forming unit. The developing device 68 is an example of a developing unit.

The toner-image forming units 60Y, 60M, 60C, 60K, 60S, and 60W form yellow (Y), magenta (M), cyan (C), black (K), special color (S), and white (W) toner images, respectively, on the outer surfaces of the photoreceptors drum 62Y, 62M, 62C, 62K, 62S, and 62W. As shown in FIG. 1, the toner-image forming units 60Y, 60M, 60C, 60K, 60S, and 60W as a whole are arranged side by side horizontally in the apparatus width direction.

Photoreceptor Drum

As shown in FIGS. 1 and 2, the photoreceptor drum 62 is cylindrical and is rotated about the axis thereof (in the direction indicated by arrow A (see FIGS. 1 and 2)) by a drive unit (not shown). The photoreceptor drum 62 includes an aluminum substrate and a photosensitive layer (not shown) including an undercoat layer, a charge generation layer, and a charge transport layer that are formed on the substrate in the above order. The photoreceptor drum 62 may further include an overcoat layer formed on the outer surface of the charge transport layer such that an electrostatic latent image is formed on the outer surface of the overcoat layer.

Charging Device

As shown in FIGS. 1 and 2, the charging device 64 is disposed along the axis of the photoreceptor drum 62 (in the apparatus depth direction). The charging device 64 negatively charges the outer surface of the photoreceptor drum 62. In this exemplary embodiment, the charging device 64 is a scorotron charging device, which is a type of corona charging device (non-contact charging device).

Exposure Device

As shown in FIGS. 1 and 2, the exposure device 66 forms an electrostatic latent image on the outer surface of the photoreceptor drum 62 charged by the charging device 64. The exposure device 66 outputs exposure light L emitted from a light-emitting diode (LED) array (not shown) based on image data received from an image signal processor (not shown) that forms part of the controller 100. The exposure light L is incident on the outer surface of the photoreceptor drum 62 charged by the charging device 64 to form an electrostatic latent image on the outer surface of the photoreceptor drum 62.

Developing Device

As shown in FIGS. 1 and 2, the developing device 68 is disposed along the axis of the photoreceptor drum 62. The developing device 68 includes a toner supply member 68A that supplies toner to the outer surface of the photoreceptor drum 62 and transport members 68B that transport toner to the toner supply member 68A (see FIG. 2). The developing device 68 develops the electrostatic latent image formed by the exposure device 66 on the outer surface of the photoreceptor drum 62 charged by the charging device 64 to form a toner image.

Removing Device

As shown in FIGS. 1 and 2, the removing device 70 is disposed along the axis of the photoreceptor drum 62. The removing device 70 includes a brush roller 70A and a blade 70B that are in contact with the outer surface of the photoreceptor drum 62. The brush roller 70A and the blade 70B remove toner (first transfer residual toner) remaining on the outer surface of the photoreceptor drum 62 without being transferred to an intermediate transfer belt 82, described later, as well as dust such as paper dust, from the outer surface of the photoreceptor drum 62.

Erasing Device

As shown in FIG. 2, the erasing device 72 is disposed along the axis of the photoreceptor drum 62. The erasing device 72 irradiates the outer surface of the photoreceptor drum 62 with light after the removing device 70 removes residual toner (first transfer residual toner) and dust such as paper dust. This irradiation allows the outer surface of the photoreceptor drum 62 to have a more uniform charge potential, thereby enabling the next image-forming operation.

Intermediate Transfer Device

As shown in FIG. 1, the intermediate transfer device 80 includes the intermediate transfer belt 82, six first transfer rollers 84, a second transfer roller 86, and rollers 88. The intermediate transfer device 80 transfers the toner images from the photoreceptor drums 62 provided for the individual toners to the intermediate transfer belt 82 such that they are overlaid on top of each other. The overlaid toner image is transferred to the medium P.

The intermediate transfer belt 82 is an endless belt entrained about the six first transfer rollers 84 and the rollers 88 and thereby set in a predetermined shape. In this exemplary embodiment, as shown in FIG. 1, the intermediate transfer belt 82 is set in the shape of an inverted obtuse triangle elongated in the apparatus width direction as viewed from the front of the image-forming apparatus 10.

Of the rollers 88 shown in FIG. 1, the roller 88A functions as a drive roller that is driven by a motor (not shown) to move the intermediate transfer belt 82 in the direction indicated by arrow B. Of the rollers 88 shown in FIG. 1, the roller 88B functions as a tension roller that tensions the intermediate transfer belt 82. Of the rollers 88 shown in FIG. 1, the roller 88C functions as a counter roller for the second transfer roller 86, described later.

As shown in FIG. 1, the intermediate transfer belt 82 is disposed in contact with the photoreceptor drums 62 from below in the apparatus height direction so as to form transfer nips T1 on the top side thereof, which extends in the apparatus width direction, in the shape described above. As the first transfer rollers 84 apply a first transfer bias voltage to the toner images formed on the photoreceptor drums 62, the toner images are transferred to the outer surface of the intermediate transfer belt 82 moving through the transfer nips T1.

As shown in FIG. 1, the intermediate transfer belt 82 is also disposed in contact with the second transfer roller 86 so as to form a transfer nip T2 at the bottom vertex thereof, which makes an obtuse angle. The toner image on the outer surface of the intermediate transfer belt 82 is supported and moved by the intermediate transfer belt 82. As the second transfer roller 86 applies a second transfer bias voltage to the toner image on the outer surface of the intermediate transfer belt 82, the toner image is transferred to the medium P passing through the transfer nip T2.

Fixing Device

The fixing device 90 includes a fixing belt 90A and a pressing roller 90B. As shown in FIG. 1, the fixing device 90 is disposed downstream of the transfer nip T2 in the transport direction of the medium P. The fixing device 90 fixes the toner image transferred to the medium P to the medium P. The fixing belt 90A is disposed opposite the side of the medium P to which the toner image is transferred. A heat source (not shown) that heats the fixing belt 90A is disposed inside the fixing belt 90A. The pressing roller 90B presses the medium P passing through the position opposite the fixing belt 90A (see FIG. 1) against the fixing belt 90A.

Medium Transport Section

The medium transport section 40 includes a medium feed unit 42 that feeds the media P to the image-forming section 20 and a medium output unit 44 that outputs a medium P on which an image is formed.

The medium feed unit 42 feeds the media P one by one to the transfer nip T2 in the image-forming section 20 in accordance with the timing of transfer. The medium output unit 44 outputs a medium P to which a toner image is fixed by the fixing device 90 outside the image-forming apparatus 10.

The medium transport section 40 also includes a retransport unit 48 that feeds a medium P to which a toner image is fixed on the front side thereof to the image-forming section 20 again. The medium transport section 40, including the retransport unit 48 as well as a transport roller 44A and a transport-direction switching unit 46, described later, allows a toner image to be formed on the front or back side of a medium P to which a toner image is fixed on the front side thereof.

To form images on both sides of the medium P, the medium transport section 40 outputs the leading portion of the medium P outside the image-forming apparatus 10. The medium transport section 40 then rotates the transport roller 44A in the reverse direction to draw the medium P back into the image-forming apparatus 10. At the same time, the medium transport section 40 switches the transport-direction switching unit 46, which is disposed between the fixing device 90 and the transport roller 44A, to transport the medium P to the retransport unit 48. Thus, the retransport unit 48 feeds the medium P to the image-forming section 20, with the back side of the medium P facing the outer surface of the intermediate transfer belt 82.

To form an image on one surface (front surface) of the medium P again, after the medium P is output from the fixing device 90, the medium transport section 40 switches the transport-direction switching unit 46 to transport the medium P to the retransport unit 48. The retransport unit 48 then feeds the medium P to the image-forming section 20 again, with the front side of the medium P facing the outer surface of the intermediate transfer belt 82.

Document Reader

The document reader 50 reads image information from a document and transmits the image information to the controller 100.

Controller

The controller 100 controls the various sections of the image-forming apparatus 10 based on image information received from the document reader 50 or an external device (not shown) such as a computer.

The controller 100 converts the image information into image signals for four colors (Y, M, C, and K) and transmit the image signals to the exposure devices 66Y, 66M, 66C, and 66K. The controller 100 also generates image signals for the special color (S) and white (W) and transmit the image signals to the exposure devices 66S and 66W.

Normal Operation of Image-Forming Apparatus

Next, the normal operation of the image-forming apparatus 10 according to the first exemplary embodiment will be described with reference to FIGS. 1 and 2. In the normal operation, the image-forming apparatus 10 forms an image on the medium P using at least one of the yellow (Y), magenta (M), cyan (C), and black (K) toners without using the special color (S) or white (W) toner.

The medium P used in this operation is normal paper (also referred to as PPC paper). Normal paper is an example of the medium P. This operation is hereinafter referred to as "first mode".

Upon receiving image information, the controller 100 operates the image-forming apparatus 10. The controller 100 converts the image information into image data for yellow (Y), magenta (M), cyan (C), and black (K). The controller 100 then outputs the image data to the exposure devices 66Y, 66M, 66C, and 66K.

The exposure devices 66 emit exposure light L based on the image data. The exposure light L is incident on the outer surfaces of the photoreceptor drums 62 charged by the charging devices 64 to form electrostatic latent images corresponding to the image data on the outer surfaces of the photoreceptor drums 62.

The electrostatic latent images formed on the outer surfaces of the photoreceptor drums 62 are developed by the developing devices 68 to form toner images.

The toner images are transferred from the outer surfaces of the photoreceptor drums 62 to the outer surfaces of the intermediate transfer belt 82 by the first transfer rollers 84 disposed opposite the outer surfaces of the photoreceptor drums 62.

A medium P is fed from any medium container 30 to the medium feed unit 42 and is transported to the transfer nip T2 in accordance with the timing when the portion of the intermediate transfer belt 82 to which the toner image is transferred reaches the transfer nip T2. The toner image is transferred from the outer surface of the intermediate transfer belt 82 to the medium P transported to and passing through the transfer nip T2.

The medium P to which the toner image is transferred is transported to the fixing device 90. In the fixing device 90, the fixing belt 90A and the pressing roller 90B heat and press the toner image to fix the toner image to the medium P.

The medium P to which the toner image is fixed is output from the medium output unit 44 outside the image-forming apparatus 10. Thus, the image-forming operation is completed.

To form images on both sides of the medium P, the image-forming apparatus 10 operates as follows. Specifically, as shown in FIG. 1, after the toner image formed on the front side of the medium P is fixed by the fixing device 90, the medium P is transported by the medium transport section 40 until the leading portion thereof is output outside the image-forming apparatus 10.

The transport roller 44A is then rotated in the reverse direction to draw the medium P back into the image-forming apparatus 10. At the same time, the transport-direction switching unit 46 is switched to transport the medium P to the retransport unit 48. The medium P is fed to the image-forming section 20 again, with the back side of the medium P facing the outer surface of the intermediate transfer belt 82.

Thereafter, a toner image is transferred to the back surface of the medium P in the transfer nip T2 and is fixed by the fixing device 90. Finally, the medium P to which the toner images are fixed on both sides thereof is output from the medium output unit 44 outside the image-forming apparatus 10. Thus, the image-forming operation is completed.

Operation of Image-Forming Apparatus for Use of White (W) Toner

Next, the operation of the image-forming apparatus 10 according to the first exemplary embodiment for the use of the white (W) toner will be described with reference to FIGS. 1 and 2. In this operation, the image-forming apparatus 10 forms an image on the medium P using at least one of the yellow (Y), magenta (M), cyan (C), and black (K) toners (hereinafter also referred to as "color toner") in combination with the white (W) toner (hereinafter also referred to as "white toner"). In this case, an overlaid image of the white toner and the color toner (hereinafter also referred to as "underlayer-based image") is formed on the medium P. The term "underlayer-based image" refers to a combination of a white toner image formed as an underlayer and a color toner image formed on the white toner image.

The time required to form an image in this operation is set to be longer than that in the normal operation. Specifically, the controller 100 changes the conditions required for the operation of the various units of the image-forming section 20; for example, it reduces the rotational speed of the photoreceptor drums 62. The controller 100 also changes the transport speed of the medium P transported by the medium transport section 40.

The medium P used in this operation is color paper such as black, blue, or red paper, i.e., paper other than white paper, rather than normal paper. Color paper is an example of the medium P. This operation is hereinafter referred to as "second mode".

Upon receiving image information, the controller 100 operates the image-forming apparatus 10. This image information contains information about the formation of an image on color paper.

The controller 100 converts the image information into image data for yellow (Y), magenta (M), cyan (C), and black (K). The controller 100 also generates image data for white (W) based on the image data for yellow (Y), magenta (M), and cyan (C). The controller 100 outputs the image data to the exposure devices 66Y, 66M, 66C, 66K, and 66W. The image data for white (W) is used to form an underlayer for a color toner image.

The exposure devices 66Y, 66M, 66C, and 66K emit exposure light L based on the image data. The exposure light L is incident on the outer surfaces of the photoreceptor drums 62Y, 62M, 62C, and 62K charged by the charging devices 64Y, 64M, 64C, and 64K to form electrostatic latent images corresponding to the image data on the outer surfaces of the photoreceptor drums 62Y, 62M, 62C, and 62K.

In synchronization with this, the exposure device 66W emits exposure light L based on the image data for white (W). The exposure light L is incident on the outer surface of the photoreceptor drum 62W charged by the charging device 64W to form an electrostatic latent image corresponding to the image data for white (W) on the outer surface of the photoreceptor drum 62W.

The electrostatic latent images formed on the outer surfaces of the photoreceptor drums 62Y, 62M, 62C, and 62K are developed by the developing devices 68Y, 68M, 68C, and 68K to form color toner images. The electrostatic latent image formed on the outer surface of the photoreceptor drum 62W is developed by the developing device 68W to form a white toner layer.

The yellow (Y), magenta (M), cyan (C), and black (K) toner images are transferred from the outer surfaces of the photoreceptor drums 62Y, 62M, 62C, and 62K to the outer surface of the intermediate transfer belt 82 by the first transfer rollers 84 disposed opposite the outer surfaces of the photoreceptor drums 62Y, 62M, 62C, and 62K. The white toner layer is transferred from the outer surface of the photoreceptor drum 62W to the outer surface of the intermediate transfer belt 82 by the first transfer roller 84 disposed opposite the outer surface of the photoreceptor drum 62W.

In this case, the white toner layer is transferred to the outer surface of the intermediate transfer belt 82 such that the white toner layer is overlaid on the color toner images previously transferred thereto.

Color paper is fed from any medium container 30 to the medium feed unit 42 and is transported to the transfer nip T2 in accordance with the timing when the underlayer-based image on the outer surface of the intermediate transfer belt 82 reaches the transfer nip T2. The underlayer-based image is transferred from the outer surface of the intermediate transfer belt 82 to the color paper transported to and passing through the transfer nip T2.

After passing through the transfer nip T2, the color paper is transported to the fixing device 90. In the fixing device 90, the fixing belt 90A and the pressing roller 90B heat and press the underlayer-based image to fix the underlayer-based image to the color paper. In this exemplary embodiment, the temperature of the outer surface of the fixing belt 90A is 160° C. In this case, the temperature at which the underlayer-based image is fixed to the color paper (hereinafter referred to as "fixing temperature") is 160° C.

The color paper is then output from the medium output unit 44 outside the image-forming apparatus 10. Thus, the image-forming operation is completed.

To form images on both sides of the color paper, after the underlayer-based image is fixed to the front side of the color paper, the color paper is drawn back into the image-forming apparatus 10 and is transported by the retransport unit 48, as in the normal operation of the image-forming apparatus 10. The color paper is then fed to the image-forming section 20 again, with the back side of the color paper facing the outer surface of the intermediate transfer belt 82, and an underlayer-based image is formed on the back side of the color paper.

In this operation, the difference in fixing time for color paper passing through the nip between the fixing belt 90A and the pressing roller 90B in the fixing device 90 satisfies expression 1 below.

Relational Expression of Fixing Time for Color Paper $$0<P(\text{ms})<30 \qquad \text{(expression 1)}$$

where P (ms)=P1−P2.

In expression 1, the fixing time P1 is the time set to fix an underlayer-based image to color paper in the second mode, and the fixing time P2 is the time set to fix an image of a color toner alone to normal paper in the first mode. As used herein, the term "fixing time" refers to the value (time) calculated by dividing the fixing nip width (mm) in the transport direction of the medium P by the transport speed (mm/ms) of the medium P.

The fixing nip width may be measured by the following method. Specifically, the image-forming apparatus 10 is used to transfer a solid image to a medium P. While the medium P passes through the fixing device 90, the image-forming operation is suspended for a predetermined period of time (e.g., 10 s). The image-forming operation is then resumed, and the medium P on which the solid image is formed is output from the image-forming apparatus 10. Because the solid image on the medium P has a portion (corresponding to the fixing nip width) with a different gloss, the width of that portion is measured as the fixing nip width.

Storage Moduli of White Toner and Color Toner

In the first exemplary embodiment, the storage modulus of a white toner at the fixing temperature is higher than that of a color toner at the fixing temperature. If the storage modulus of the white toner is lower than that of the color toner, part of the white toner is absorbed into the color paper at the fixing temperature at which the color reproducibility after the fixing of the color toner is within the acceptable range. This decreases the hiding power of the white toner on the color paper.

The storage modulus of the white toner is $1.0\times10^4$ Pa or less or about $1.0\times10^4$ Pa or less. If the storage modulus of the white toner is more than $1.0\times10^4$ Pa or more than about $1.0\times10^4$ Pa, the white toner is partially not melted at a fixing temperature of 160° C. and thus forms an uneven underlayer with gaps. This decreases the hiding power of the white toner.

The storage modulus G' of a toner is the real part of the shear complex modulus G* at a measurement temperature of T° C. Specifically, the storage modulus G' is measured by a viscoelastometer according to the method specified in JIS K 7244-6, entitled "Plastics—Determination of Dynamic Mechanical Properties—Part 6: Shear Vibration—Non-Resonance Method".

In this operation, as represented by expression 1, the fixing time P1 for which an underlayer-based image is fixed to color paper is longer than the fixing time P2 for which an image of a color toner alone is fixed to normal paper. The difference between the times P1 and P2 (time P) is less than 30 ms.

Figure 3:
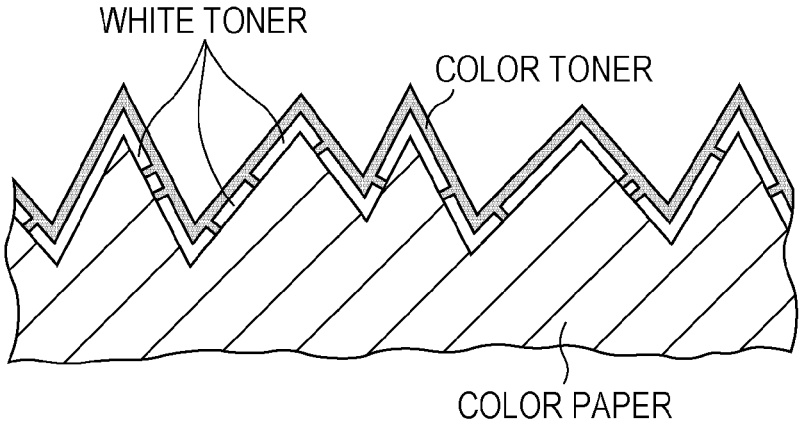
FIG. 3 is a conceptual diagram (sectional view) illustrating the condition of an image formed on color paper in a comparative example where $P \leq 0$ in expression 1.

For P≤0, as illustrated in the conceptual diagram in FIG. 3, the color toner is completely melted, although the white toner is partially not melted. This results in absorption of the melted color toner into gaps in the underlayer of the white toner or gaps in the white toner during fixing.

Figure 4:
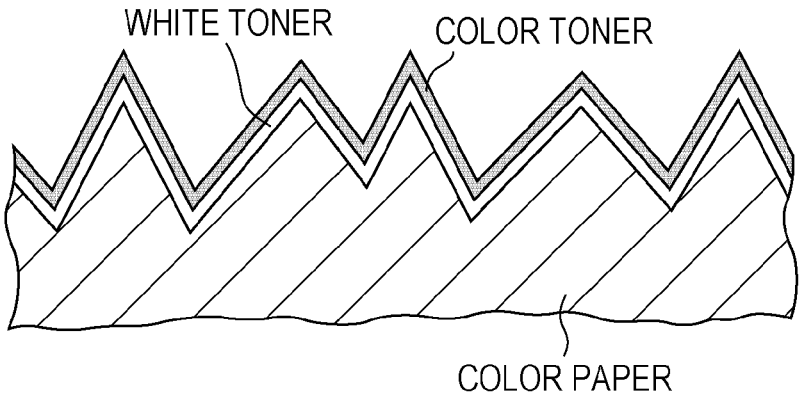
FIG. 4 is a conceptual diagram (sectional view) illustrating the condition of an image formed on color paper in an example where $0<P<30$ in expression 1.

In contrast, if expression 1 is satisfied, as illustrated in the conceptual diagram in FIG. 4, the white toner is completely melted. This may result in absorption of little color toner into gaps in the underlayer of the white toner or gaps in the white toner.

Figure 5:
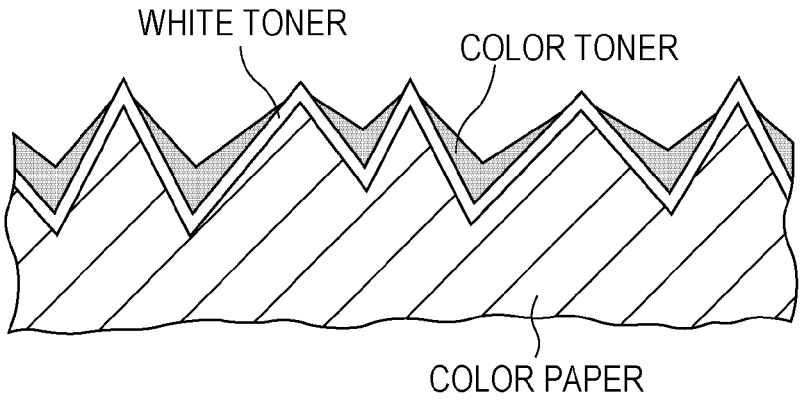
FIG. 5 is a conceptual diagram (sectional view) illustrating the condition of an image formed on color paper in a comparative example where $P \geq 30$ in expression 1.

For P≥30, as illustrated in the conceptual diagram in FIG. 5, the white toner is completely melted, although part of the white toner appears as white spots in the underlayer-based image. This is because the color toner melts excessively and sinks into recesses in the surface of the paper (color paper), which has protrusions and recesses of sizes larger than or equal to the size of toner particles.

In contrast, if expression 1 is satisfied, as illustrated in the conceptual diagram in FIG. 4, the color toner does not melt excessively. This may result in little white toner appearing as white spots in the underlayer-based image.

Thus, according to the first exemplary embodiment, the decrease in the color reproducibility of an underlayer-based image on color paper may be reduced compared to the case where expression 1 is not satisfied (see FIG. 4).

The fixing energy applied to the medium P depends on the pressure on the medium P, the time for which the medium P is heated, and the temperature of the member that heats the medium P, such as a fixing belt. In the first exemplary embodiment, the fixing energy applied to color paper is adjusted depending on the fixing time without varying the pressure on the color paper or the temperature of the fixing belt 90A in the first and second modes.

If the pressure on the color paper is changed (increased), defects such as mixing of the white toner with the color toner and displacement of the white toner may occur during the passage of the color paper through the fixing nip. In the first exemplary embodiment, few defects such as mixing of the white toner with the color toner and displacement of the white toner may occur because the fixing energy is adjusted depending on the fixing time without varying the pressure on the color paper in the first and second modes.

If the temperature of the fixing belt 90A is changed (increased), the gloss of the underlayer-based image on the color paper varies after the passage of the color paper through the fixing nip. In the first exemplary embodiment, the gloss of the underlayer-based image on the color paper may vary little because the fixing energy is adjusted depending on the fixing time without varying the temperature of the member such as the fixing belt 90A in the first and second modes.

Thus, according to the first exemplary embodiment, the decrease in the color reproducibility of an underlayer-based image on color paper may be reduced compared to the case where an underlayer-based image is fixed to color paper such that the pressure on the color paper or the temperature of the member such as the fixing belt is higher than that in the first mode.

Second Exemplary Embodiment

Next, a second exemplary embodiment will be described with reference to FIGS. 6 and 7, focusing on the differences from the exemplary embodiment described above. The second exemplary embodiment differs in that the medium P is a film rather than color paper. The film (medium P) used in the second exemplary embodiment is a transparent film. Films are an example of the medium P. The operation in which an underlayer-based image is formed on a film is hereinafter referred to as "third mode".

Instead of expression 1, the second exemplary embodiment satisfies expression 2 below.

Relational Expression of Fixing Time for Film $$10<F(\text{ms})<80 \quad \text{(expression 2)}$$

where F (ms)=F1−P2.

In expression 2, the fixing time F1 is the time set to fix an underlayer-based image to a film in the third mode.

In the second exemplary embodiment, as represented by expression 2, the fixing time F1 for which an underlayer-based image is fixed to a film is longer than the fixing time P2 for which an image of a color toner alone is fixed to normal paper. The difference between the times F1 and P2 (time F) is more than 10 ms and less than 80 ms.

Figure 6:
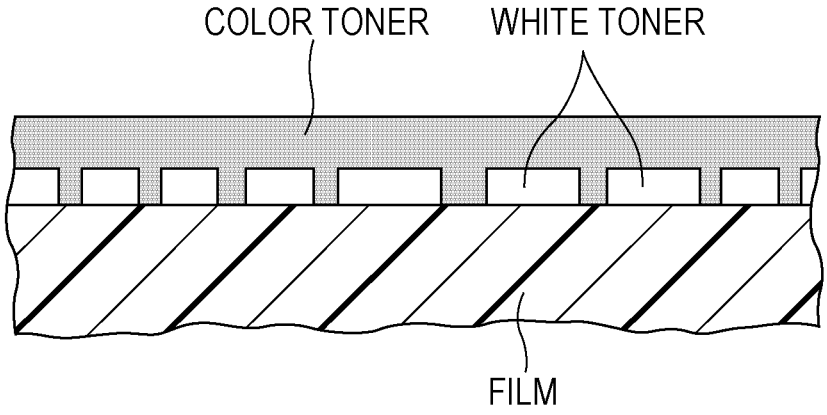
FIG. 6 is a conceptual diagram (sectional view) illustrating the condition of an image formed on a film in a comparative example where $F \leq 10$ in expression 2.

For F≤10, as illustrated in the conceptual diagram in FIG. 6, the color toner is completely melted, although the white toner is partially not melted. This results in absorption of the melted color toner into gaps in the underlayer of the white toner or gaps in the white toner, thus decreasing the color reproducibility.

Figure 7:
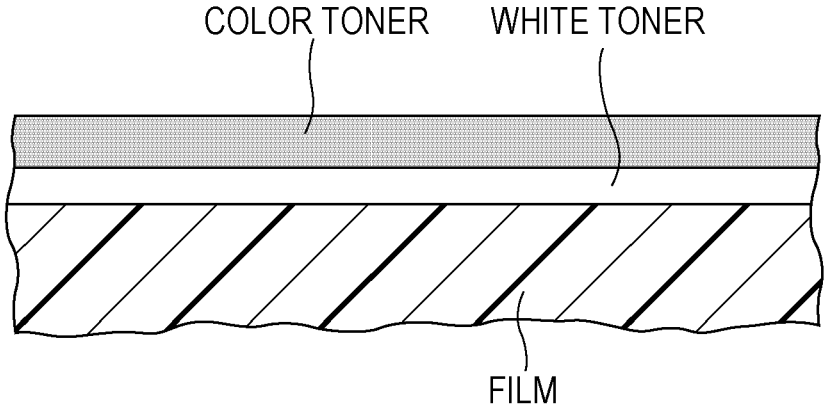
FIG. 7 is a conceptual diagram (sectional view) illustrating the condition of an image formed on a film in an example where $10<F<80$ in expression 2.

In contrast, if expression 2 is satisfied, as illustrated in the conceptual diagram in FIG. 7, the white toner is completely melted. This may result in absorption of little color toner into gaps in the underlayer of the white toner or gaps in the white toner.

Figure 8:
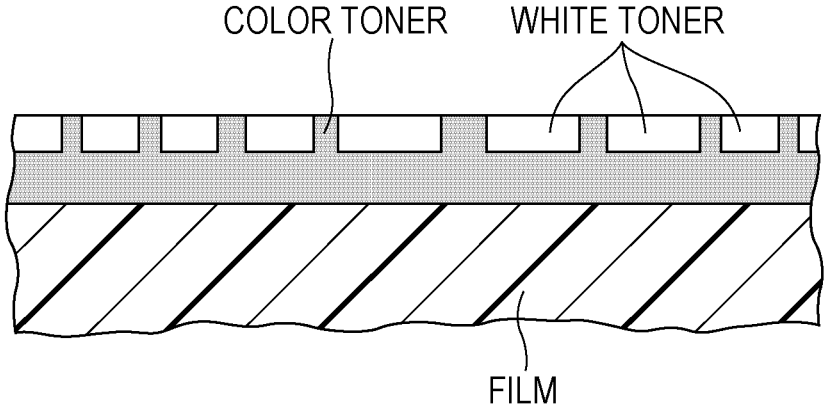
FIG. 8 is a conceptual diagram (sectional view) illustrating the condition of an image formed on a film in a comparative example where $F \geq 80$ in expression 2.

For F≥80, as illustrated in the conceptual diagram in FIG. 8, both of the white toner and the color toner melt completely, although the color toner melts excessively. This might cause part of the excessively melted color toner to be transferred to the surface of the fixing belt 90A when the film being transported is separated from the fixing belt 90A (i.e., hot offset). In addition, the excessively melted color toner might slip between the film and the fixing belt 90A, which results in a color shift. Furthermore, color mixing might occur if the color toner and the white toner melt excessively.

In contrast, if expression 2 is satisfied, as illustrated in the conceptual diagram in FIG. 7, the color toner does not melt excessively. This may reduce the risk of hot offset, color shift, or color mixing.

Thus, according to the second exemplary embodiment, the decrease in the color reproducibility of an underlayer-based image on a film may be reduced compared to the case where expression 2 is not satisfied (see FIG. 7).

Third Exemplary Embodiment

Next, a third exemplary embodiment will be described, focusing on the differences from the exemplary embodiments described above. The third exemplary embodiment combines the functions of the first and second exemplary embodiments described above. That is, the third exemplary embodiment has the first, second, and third modes. The controller 100 selects one of the three modes based on received medium information to perform an image-forming operation.

Color paper and films, which are used as the medium P in the exemplary embodiments described above, differ in the toner mass per unit area (hereinafter referred to as "TMA ($g/m^2$)") required for the white toner to provide sufficient color reproducibility. Specifically, the TMA of the white toner in the second mode is set to be higher than that of the white toner in the third mode. This is because color paper has protrusions and recesses in the surface thereof, and the white toner is absorbed into the recesses, which decreases the hiding power on the protrusions. In addition, because films tend to absorb the thermal energy applied thereto, poor fixing due to lack of thermal energy is more likely to occur on films than on color paper. Furthermore, as the underlayer of the white toner becomes thicker, it requires a larger thermal energy. This may result in insufficient fixing of the underlayer of the white toner, which decreases the hiding power and thus decreases the color reproducibility. Thus, the thickness (TMA) of the underlayer on films may be minimized taking into account the properties of films, which are different from those of color paper.

Thus, according to the third exemplary embodiment, an image may be formed while reducing the decrease in color reproducibility depending on the medium P selected compared to the case where the functions of the first and second exemplary embodiments described above are not combined. The other advantages are the same as those of the exemplary embodiments described above.

Modification of Third Exemplary Embodiment

Next, a modification of the third exemplary embodiment will be described, focusing on the differences from the exemplary embodiments described above. In this modification, the difference P in fixing time for the formation of an image on color paper is smaller than the difference F in fixing time for the formation of an image on a film (see expression 3).

Relational Expression of Fixing Times for Color Paper and Film $$P(\text{ms})<F(\text{ms}) \quad \text{(expression 3)}$$

The relationship of expression 3 is based on the following reasons. First, films have higher heat capacities than color paper. Second, the white toner is less easily fixed to films than to color paper because films absorb little white toner. If the white toner is not completely melted, then even if the color toner is completely melted, the color toner may come off the film together with the underlayer of the white toner. Thus, films require a larger thermal energy than color paper.

In contrast, according to the modification of the third exemplary embodiment, in which expression 3 is satisfied, the decrease in the color reproducibility of an underlayer-based image on color paper or film may be reduced compared to the case where expression 3 is not satisfied.

Fourth Exemplary Embodiment

Next, a fourth exemplary embodiment will be described, focusing on the differences from the exemplary embodiments described above. The fourth exemplary embodiment does not have the second mode or the third mode as in the third exemplary embodiment; instead, it has a single mode (fourth mode). Specifically, an image is formed within the overlapping range of P in expression 1 and F in expression 2. The overlapping range (M) of P and F is represented by expression 4 below.

Relational Expression of Fixing Time for Color Paper or Film $$10<M(\text{ms})<30 \quad \text{(expression 4)}$$

The fourth exemplary embodiment has the same advantages as the exemplary embodiments described above.

Fifth Exemplary Embodiment

Next, a fifth exemplary embodiment will be described, focusing on the differences from the exemplary embodiments described above. The fifth exemplary embodiment forms an overlaid image of a white toner and color toners in which the color toners and the white toner are overlaid on a film in the above order. This image is intended to be viewed from the side where no image is formed. The fifth exemplary embodiment satisfies expression 2.

An image-forming apparatus 10A (not shown) according to the fifth exemplary embodiment is a modification of the image-forming apparatus 10. Specifically, the image-forming apparatus 10 is modified as the image-forming apparatus 10A by replacing the toner-image forming unit 60Y with the toner-image forming unit 60W and shifting the toner-image forming units 60Y, 60M, 60C, 60K, and 60S downstream in the transport direction of the intermediate transfer belt 82. With this arrangement, an underlayer of the white toner is initially transferred to the intermediate transfer belt 82. Thus, the image-forming apparatus 10A forms an overlaid image of the white toner and the color toners in which the color toners and the white toner are overlaid on a film in the above order.

The fifth exemplary embodiment has the same advantages as the exemplary embodiments described above.

Although particular exemplary embodiments of the present invention have been described in detail, the present invention is not limited to these exemplary embodiments; various other exemplary embodiments are possible within the scope of the present invention.

If the white toner is frequently used in image-forming operation, the toner-image forming unit 60S may be configured for use with the same white toner as the toner-image forming unit 60W. Alternatively, the toner-image forming units 60S and 60W may be configured for use with white toners having different color-forming properties.

Films are not limited to transparent films made of resins such as polyethylene terephthalate (PET) and polyvinyl chloride, but include color films containing dyes.

Although a white toner layer has been described as an underlayer for a color toner image, the image-forming apparatuses may have a mode in which images such as characters and patterns are formed using a white toner.

Although a black (K) toner image has been described as being formed above a white toner layer formed as an underlayer, a black (K) toner image may be directly formed on color paper or film without forming a white toner layer as an underlayer.

Although the fixing time has been described as being set using the transport speed of the medium P as a parameter, the fixing nip width may instead be adjusted to satisfy expressions 1 and 2.

Although the fixing device 90 has been described as being configured as a fixing device for fixing in contact with the surface of the medium P, it may instead be configured as a non-contact fixing device including, for example, a halogen lamp disposed opposite the medium P without contact. In this case, the width of light emitted from the halogen lamp in the transport direction of the medium P may be adjusted instead of changing the fixing nip width.

The time required for the image-forming operation has been described as being set to be longer in the second and third modes than in the first mode. The image-forming operation, however, may be performed at the same speed as the normal operation until the rear end of the medium P passes through the transfer nip T2, and then the transport speed of the medium P may be reduced so that the fixing time becomes longer.

Although an underlayer-based image has been described as being simultaneously transferred to the medium P by second transfer, color toner images and a white toner layer may be formed on the respective image carriers and may then be sequentially transferred to the medium P.

Although toner images have been described as being formed by toner-image forming units provided for individual colors, color toner images and a white toner layer may be sequentially formed on a single photoreceptor drum and transferred to the intermediate transfer belt 82 and may then be simultaneously transferred to the medium P.

EXAMPLES

Methods for Manufacturing Toners and Developers

Next, methods for manufacturing the toners used in the exemplary embodiments (including the modification) described above will be described. The binder used for the toners will be described first, and then the toners and developers will be described.

Binder

Preparation of Crystalline Polyester Resin (Particle Dispersion)

A three-necked flask dried by heating is charged with 266 parts of 1,12-dodecanedicarboxylic acid, 169 parts of 1,10-decanediol, and 0.035 part of tetrabutoxy titanate as a catalyst. After the air pressure in the flask is reduced by a pressure-reducing operation, nitrogen gas is supplied to create an inert atmosphere. The mixture is refluxed at 180° C. with mechanical stirring for 6 hours. Thereafter, the mixture is gradually heated to 220° C. under vacuum distillation and is stirred for 2.5 hours. When the mixture becomes viscous, the acid value thereof is measured. When the acid value reaches 15.0 mg KOH/g, vacuum distillation is stopped, and the reaction product is cooled in air to yield a crystalline polyester resin.

The weight average molecular weight (Mw) of the resulting crystalline polyester resin is measured to be 13,000. The melting temperature of the resulting crystalline polyester resin is 73° C. as measured by differential scanning calorimetry (DSC).

To a stainless steel beaker are added 180 parts of the resulting crystalline polyester resin and 585 parts of deionized water. The beaker is heated to 95° C. in a hot bath. After the crystalline polyester resin melts, the mixture is stirred at 8,000 rpm with a homogenizer (ULTRA-TURRAX T50 available from IKA Works, Inc.) while adding dilute aqueous ammonia to a pH of 7.0. The mixture is dispersed and emulsified while adding dropwise 20 parts of an aqueous solution containing 0.8 part of an anionic surfactant (Neogen R available from Dai-Ichi Kogyo Seiyaku Co., Ltd.) to prepare crystalline polyester resin particle dispersion A (resin particle content=40% by mass) with a volume average particle size of 0.23 μm.

Preparation of Amorphous Polyester Resin (Particle Dispersion)

A two-necked flask dried by heating is charged with 74 parts of dimethyl adipate, 192 parts of dimethyl terephthalate, 216 parts of ethylene oxide adduct of bisphenol A, 38 parts of ethylene glycol, and 0.037 part of tetrabutoxy titanate as a catalyst. Nitrogen gas is supplied to the flask to maintain an inert atmosphere. The mixture is heated with stirring to effect a co-condensation polymerization reaction at 160° C. for about 7 hours. Thereafter, the mixture is heated to and maintained at 220° C. for 4 hours while gradually reducing the pressure in the flask to $1.3\times10^3$ Pa. After the pressure in the flask is returned to normal pressure, 9 parts of trimellitic anhydride is added. The pressure in the flask is then gradually reduced to $1.3\times10^3$ Pa again and is maintained thereat for 1 hour to synthesize an amorphous polyester resin.

The glass transition temperature of the resulting amorphous polyester resin is 60° C. as measured in the same manner as described above, i.e., by DSC. The weight average molecular weight (Mw) of the resulting amorphous polyester resin is 12,000 as measured by GPC. The acid value of the resulting amorphous polyester resin is measured to be 25.0 mg KOH/g.

A mixture of 115 parts of the resulting amorphous polyester resin, 180 parts of deionized water, and 5 parts of an anionic surfactant (Neogen R available from Dai-Ichi Kogyo Seiyaku Co., Ltd.) is prepared and is heated to 120° C. The mixture is sufficiently dispersed with a homogenizer (ULTRA-TURRAX T50 available from IKA Works, Inc.) and is then dispersed with a pressure discharge Gaulin Homogenizer for 1 hour to prepare amorphous polyester resin particle dispersion B (resin particle content=40% by mass).

Preparation of Colorant Dispersions

Preparation of White Colorant Dispersion W1

A mixture of 100 parts of a white pigment (titanium oxide, A220 available from Ishihara Sangyo Kaisha, Ltd., primary particle size=0.16 μm), 15 parts of an anionic surfactant (Neogen R available from Dai-Ichi Kogyo Seiyaku Co., Ltd.), and 400 parts of ion exchange water is prepared. The mixture is dispersed with an Ultimaizer high-pressure impact disperser (HJP30006 available from Sugino Machine Ltd.) for about 3 hours to prepare white colorant dispersion W1. The volume average particle size of the colorant (titanium oxide) in white colorant dispersion W1 is 0.240 μm as measured by a laser diffraction particle size analyzer. The solids content of white colorant dispersion W1 is 23% by mass.

Methods for Manufacturing White Toners

This comparative experiment uses two types of white toners. White toner 1 is used in Examples 1 to 5 and Comparative Examples 1 to 4 in FIG. 10. White toner 2 is used in Comparative Example 5 in FIG. 10.

Method for Manufacturing White Toner 1

A round stainless steel flask is charged with 37.5 parts of crystalline polyester resin dispersion A, 292.5 parts of amorphous polyester resin dispersion B, 391.3 parts of white colorant dispersion W1, 90.0 parts of a release agent dispersion, and 484 parts of deionized water. The mixture is sufficiently mixed and dispersed with an ULTRA-TURRAX T50. To the mixture is added 0.37 part of polyaluminum chloride, and dispersion is continued with the ULTRA-TURRAX. The flask is then heated to 52° C. with stirring in a heating oil bath. After the mixture is maintained at 52° C. for 3 hours, 150 parts of amorphous polyester resin dispersion B is gradually added.

Thereafter, the reaction system is adjusted to a pH of 8.5 with 0.5 N aqueous sodium hydroxide solution, and the stainless steel flask is sealed. The mixture is then heated to and maintained at 90° C. under continued stirring with a stirrer for 3.5 hours. After the reaction is completed, the reaction product is cooled, filtered, and sufficiently washed with ion exchange water. The solids are separated from the liquid by Nutsche suction filtration. The solids are then dispersed again in 3 L of ion exchange water at 40° C. and are stirred and washed at 300 rpm for 15 minutes.

This operation is repeated another five times. When the filtrate has a pH of 6.88, an electrical conductivity of 8.4 μS/cm, and a surface tension of 7.02 Nm, the solids are separated from the liquid by Nutsche suction filtration through No. 5A filter paper and are dried in vacuo for 12 hours to yield toner particles. The glass transition temperature of the resulting white toner particles is measured to be 55.0° C. The volume average particle size D50v of the resulting white toner particles is measured to be 6.5 μm.

To 100 parts of the resulting white toner particles is added 1 part of hydrophobic silica particles (RY-50 available from Nippon Aerosil Co., Ltd.). The mixture is mixed in a Henschel mixer to yield white toner 1. The storage modulus of white toner 1 is measured to be $1.0\times10^3$ Pa (see FIG. 10).

Method for Manufacturing White Toner 2

A round stainless steel flask is charged with 330.0 parts of amorphous polyester resin dispersion B, 391.3 parts of white colorant dispersion W1, 90.0 parts of a release agent dispersion, and 484 parts of deionized water. The mixture is sufficiently mixed and dispersed with an ULTRA-TURRAX T50. To the mixture is added 0.37 part of polyaluminum chloride, and dispersion is continued with the ULTRA-TURRAX. The flask is then heated to 52° C. with stirring in a heating oil bath. After the mixture is maintained at 52° C. for 3 hours, 150 parts of amorphous polyester resin dispersion B is gradually added.

Thereafter, the reaction system is adjusted to a pH of 8.5 with 0.5 N aqueous sodium hydroxide solution, and the stainless steel flask is sealed. The mixture is heated to and maintained at 90° C. under continued stirring with a stirrer for 3.5 hours. After the reaction is completed, the reaction product is cooled, filtered, and sufficiently washed with ion exchange water. The solids are separated from the liquid by Nutsche suction filtration. The solids are then dispersed again in 3 L of ion exchange water at 40° C. and are stirred and washed at 300 rpm for 15 minutes.

This operation is repeated another five times. When the filtrate has a pH of 6.88, an electrical conductivity of 8.4 μS/cm, and a surface tension of 7.02 Nm, the solids are separated from the liquid by Nutsche suction filtration through No. 5A filter paper and are dried in vacuo for 12 hours to yield toner particles. The glass transition temperature of the resulting white toner particles is measured to be 58.0° C. The volume average particle size D50v of the resulting white toner particles is measured to be 6.5 μm.

To 100 parts of the resulting white toner particles is added 1 part of hydrophobic silica particles (RY-50 available from Nippon Aerosil Co., Ltd.). The mixture is mixed in a Henschel mixer to yield white toner 2. The storage modulus of white toner 2 is measured to be $1.0\times10^{4.2}$ Pa (see FIG. 10).

Method for Manufacturing Color Toners

Color toners are manufactured from crystalline polyester resin dispersion A and amorphous polyester resin particle dispersion B (resin particle content=40% by mass) in the same manner as the white toners described above.

Specifically, a round stainless steel flask is charged with 37.5 parts of crystalline polyester resin dispersion A, 292.5 parts of amorphous polyester resin dispersion B, 391.3 parts of a color colorant dispersion, 90.0 parts of a release agent dispersion, and 484 parts of deionized water. The mixture is sufficiently mixed and dispersed with an ULTRA-TURRAX T50. To the mixture is added 0.32 part of polyaluminum chloride, and dispersion is continued with the ULTRA-TURRAX. The flask is then heated to 52° C. with stirring in a heating oil bath. After the mixture is maintained at 52° C. for 3 hours, 150 parts of amorphous polyester resin dispersion B is gradually added.

Thereafter, the reaction system is adjusted to a pH of 8.5 with 0.5 N aqueous sodium hydroxide solution, and the stainless steel flask is sealed. The mixture is heated to and maintained at 90° C. under continued stirring with a stirrer for 3.5 hours. After the reaction is completed, the reaction product is cooled, filtered, and sufficiently washed with ion exchange water. The solids are separated from the liquid by Nutsche suction filtration. The solids are then dispersed again in 3 L of ion exchange water at 40° C. and are stirred and washed at 300 rpm for 15 minutes.

This operation is repeated another five times. When the filtrate has a pH of 6.88, an electrical conductivity of 8.4 μS/cm, and a surface tension of 7.02 Nm, the solids are separated from the liquid by Nutsche suction filtration through No. 5A filter paper and are dried in vacuo for 12 hours to yield toner particles.

The glass transition temperature of the resulting color toner particles is measured to be 54.0° C. The volume average particle size D50v of the resulting color toner particles is measured to be 6.5 μm.

Method for Manufacturing Black Toner (Black (K) Toner)

Preparation of Black Colorant Dispersion B1

A mixture of 99 parts of carbon black (Regal 330 (available from Cabot Corporation)), 15 parts of an anionic surfactant (Neogen R available from Dai-Ichi Kogyo Seiyaku Co., Ltd.), and 300 parts of ion exchange water is prepared and is dispersed with a homogenizer (ULTRA-TURRAX T50 available from IKA Works, Inc.) for 10 minutes. The mixture is then processed in a circulating ultrasonic disperser (RUS 600TCVP available from Nihonseiki Kaisha Ltd.) to yield black colorant dispersion B1.

The volume average particle size of the colorant (carbon black) in black colorant dispersion B1 is 0.25 μm as measured by a laser diffraction particle size analyzer. The solids content of black colorant dispersion B1 is 23% by mass.

Manufacture of Black Toner

A black toner is manufactured in the same manner as white toner 1 except that crystalline polyester resin dispersion A and amorphous polyester resin dispersion B are initially added in amounts of 75.0 parts and 435.0 parts, respectively, and black colorant dispersion B1 is added in an amount of 78.3 parts instead of white colorant dispersion W1.

Manufacture of Developers

To 1.25 parts of toluene is added 0.12 part of carbon black (available under the trade name VXC 72 from Cabot Corporation), and it is stirred and dispersed in a sand mill for 20 minutes to prepare a carbon dispersion. To the carbon dispersion, 1.20 parts of an 80% ethyl acetate solution of a trifunctional isocyanate (Takenate D110N available from Takeda Pharmaceutical Company Limited) is added with stirring to prepare a coating resin solution. A kneader is charged with the coating resin solution and Mn—Mg—Sr ferrite particles (volume average particle size=35 μm). The mixture is stirred at room temperature for 5 minutes and is then heated to 150° C. under normal pressure to remove the solvent. After the mixture is stirred for another 30 minutes, the heater is powered off, and the mixture is allowed to cool to 50° C. with stirring. The resulting coated carrier is passed through a 75 μm mesh to obtain a carrier.

A developer of each color is prepared by mixing 95 parts of the carrier and 8 parts of the resulting toner in a V-blender.

Measurement of Storage Modulus of Each Toner

Figure 9:
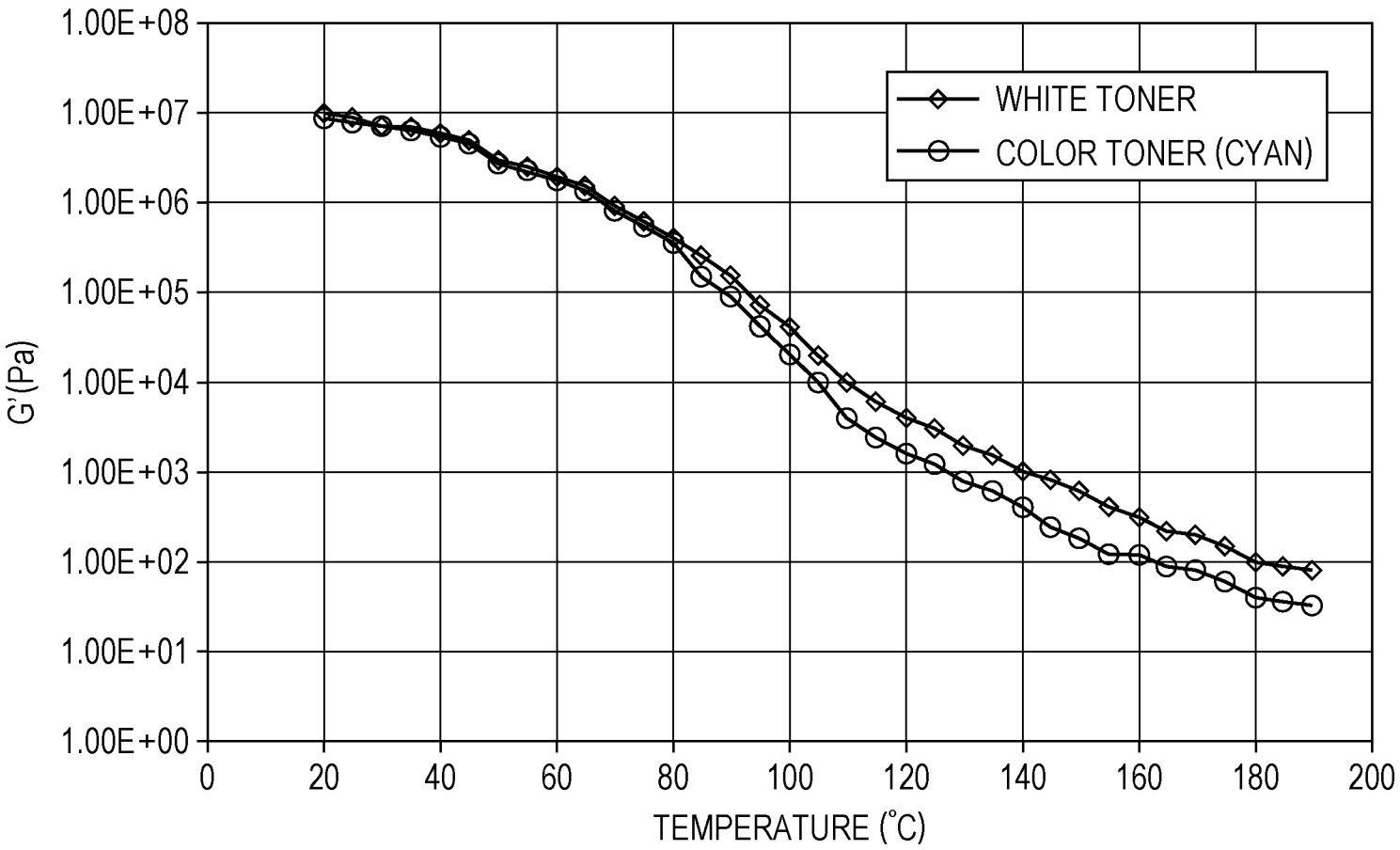
FIG. 9 is a graph showing the storage modulus of a white toner prepared in the Examples.

FIG. 9 is a graph showing the storage moduli of the toners (white toner 1 and color toner) prepared by the methods described above as measured by the measurement method described above.

Comparative Experiment

Next, a fixing test and an image quality test are performed under the fixing conditions shown in the table in FIG. 10.

Sample Preparation

Samples for the fixing test and the image quality test are prepared using a modified DocuCentre-IV C5575 (available from Fuji Xerox Co., Ltd.) and a modified Color 1000 Press (available from Fuji Xerox Co., Ltd.).

In these modified printers, the developing device for black (K) is charged with the white (W) developer, and the developing device for cyan (C) is charged with the magenta (M) developer. When an image is produced on a film, the developing device for black (K) is charged with the magenta (M) developer, and the developing device for cyan (C) is charged with the white (W) developer.

The fixing devices in these modified printers are adapted so that the temperature, the fixing nip width, the pressure, and the speed are variable. These modified printers are used to prepare the following samples.

Samples of images of color toners directly formed on white paper, color paper (black paper), and films are prepared by forming a blue solid image with a TMA of 8 g/m$^2$. The TMA of the magenta (M) toner in the blue solid image is 4 g/m$^2$, and the TMA of the cyan (C) toner in the blue solid image is 4 g/m$^2$.

Samples of images of white and color toners formed on color paper (black paper) and films are prepared by forming a white (W) toner layer with a TMA of 6 g/m$^2$ and then forming a blue solid image with a TMA of 8 g/m$^2$ on the white (W) toner layer. The TMA of the magenta (M) toner in the blue solid image is 4 g/m$^2$, and the TMA of the cyan (C) toner in the blue solid image is 4 g/m$^2$.

Fixing Test

The fixing test is performed on the four types of samples prepared using the modified printers described above as follows.

The color paper is tested by a crease test. The crease test is performed by rolling a roller with a weight of about 500 g and an outer diameter of 60 mm twice at constant speed over a sample lightly bent in half, lightly rubbing the crease formed in the fixed image with cloth, and measuring the width of the missing portion of the image. A sample having a missing portion with a width of less than 0.5 mm is rated as good, and a sample having a missing portion with a width of 0.5 mm or more is rated as poor.

The films are tested by a pencil hardness test. The pencil hardness test is a pencil scratch test according to JIS K5400 in which the samples are evaluated for pencil hardness. A sample with a pencil hardness of H or higher is rated as good. A sample with a pencil hardness of HB or lower is rated as poor.

The results of the fixing test are shown in the table in FIG. 11.

Image Quality Test

Samples different from those used for the fixing test are prepared for the image quality test.

A sample is prepared using color paper (black paper) by forming a white (W) toner layer on color paper and then forming a solid image of the magenta (M) toner on the white (W) toner layer. The solid image is formed in a pattern called a solid patch with a size of 5 cm×5 cm.

Two types of samples are prepared using films. One sample is prepared by forming a white (W) toner layer on a film and then forming a solid image of the magenta (M) toner (5 cm×5 cm solid patch) on the white (W) toner layer (sample A). The other sample is prepared by forming a solid image of the magenta (M) toner (5 cm×5 cm solid patch) on a film and then forming a white (W) toner layer on the solid image (sample B).

The sample of color paper and sample A are tested on the side where an image is formed. Sample B is tested on the side opposite the side where an image is formed.

For color reproducibility, the a* value is measured to determine the color reproducibility of magenta (M) (whether white (W) appears in the surface), and the c* value is measured to determine the hiding power. The measurements are performed using an Xrite, with the black portion of a JIS hiding power chart (available from Motofuji) placed below the films. The results of the image quality test are shown in the table in FIG. 12.

The black paper used is TANT N-1 (ream weight: 70 kg, A4, long grain, available from Takeo Co., Ltd.). The white paper used for comparison is TANT N-9 (ream weight: 70 kg, A4, long grain, available from Takeo Co., Ltd.). The films used are OHP films (available from Fuji Xerox Co., Ltd.).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an image unit configured to form an image using at least one of a white toner and a color toner having a lower storage modulus than the white toner;

a fixing unit configured to fix the image to a medium with heat; and a controller configured to determine a color paper fixing time P based on a first mode and a second mode of the image-forming apparatus, the color paper fixing time P calculated by subtracting a first fixing time of the first mode from a second fixing time of the second mode, the color paper fixing time P being greater than 0 ms and less than 30 ms, wherein the first mode represents an operation where an image of the color toner alone is fixed to a normal paper used as the medium, wherein the second mode represents an operation where an overlaid image of the white toner and the color toner is fixed to color paper used as the medium.

2. The image-forming apparatus according to claim 1, wherein the controller is configured to calculate a film fixing time F by subtracting the first fixing time from a third fixing time of a third mode, the film fixing time being greater than 10 ms and less than 80 ms, and wherein the third mode represents an operation where an overlaid image of the white toner and the color toner is fixed to a film used as the medium is more than 10 ms and less than 80 ms.

3. The image-forming apparatus according to claim 2, wherein the color paper fixing time P is shorter than the film fixing time F.

4. The image-forming apparatus according to claim 1, wherein the storage modulus of the white toner at a fixing temperature at which the image is fixed to the medium is about 1.0×10$^4$ Pa or less.

5. The image-forming apparatus according to claim 2, wherein the storage modulus of the white toner at a fixing temperature at which the image is fixed to the medium is about 1.0×10$^4$ Pa or less.

6. The image-forming apparatus according to claim 3, wherein the storage modulus of the white toner at a fixing temperature at which the image is fixed to the medium is about 1.0×10$^4$ Pa or less.

7. The image-forming apparatus according to claim 1, wherein the second fixing time is longer than the first fixing time.

8. The image-forming apparatus according to claim 1, wherein the color paper fixing time represents a time calculated by dividing a fixing nip width in a transport direction by a transport speed of the medium.

9. An image-forming apparatus comprising:

an image unit configured to form an image using at least one of a white toner and a color toner having a lower storage modulus than the white toner;

a fixing unit configured to fix the image to a medium with heat; and a controller configured to determine a film fixing time F based on a first mode and a third mode of the image-forming apparatus, the film fixing time F calculated by subtracting a first fixing time of the first mode from a third fixing time of the third mode, the color paper fixing time P being greater than 10 ms and less than 80 ms, wherein the first mode represents an operation where an image of the color toner alone is fixed to a normal paper used as the medium, and wherein the third mode represents an operation where an overlaid image of the white toner and the color toner is fixed to a film used as the medium.

10. The image-forming apparatus according to claim 9, wherein the storage modulus of the white toner at a fixing temperature at which the image is fixed to the medium is about $1.0\times10^4$ Pa or less.

11. The image-forming apparatus according to claim 9, wherein the film fixing time represents a time calculated by dividing a fixing nip width in a transport direction by a transport speed of the medium.

12. An image-forming apparatus comprising:

an image unit configured to form an image using at least one of a white toner and a color toner having a lower storage modulus than the white toner; and a fixing unit configured to fix the image to a medium with heat, a controller configured to determine a paper fixing time M based on a color paper fixing time and a film fixing time, the paper fixing time M being greater than 10 ms and less than 30 ms.

wherein the paper fixing time M is calculated by subtracting a fixing time for which an image of the color toner alone is fixed to a normal paper used as the medium from a fixing time for which an overlaid image of the white toner and the color toner is fixed to the medium, and wherein the paper fixing time is an overlap time of the color paper fixing time and the film fixing time.

13. The image-forming apparatus according to claim 12, wherein the paper fixing time represents a time calculated by dividing a fixing nip width in a transport direction by a transport speed of the medium.

* * * * *